United States Patent [19]

Hirota et al.

[11] 4,421,681

[45] Dec. 20, 1983

[54] LIQUID DETERGENT COMPOSITION COMPRISING AMMONIUM ALKYL SULFATE, POLYOXYALKYLENE ALKYL ETHER AND FATTY ACID DIALKANOLAMIDE

[75] Inventors: Hajime Hirota, Tokyo; Hiroshi Watanabe, Funabashi, both of Japan

[73] Assignee: Kao Soap Co., Ltd., Tokyo, Japan

[21] Appl. No.: 346,713

[22] Filed: Feb. 8, 1982

[30] Foreign Application Priority Data

Feb. 23, 1981 [JP] Japan ..... 56-25258

[51] Int. Cl.[3] ..... C11D 1/14

[52] U.S. Cl. ..... 252/541; 252/545; 252/548; 252/550; 252/DIG. 13; 252/DIG. 14

[58] Field of Search ..... 252/545, 548, 550, DIG. 14, 252/541

[56] References Cited

U.S. PATENT DOCUMENTS 3,954,660 5/1976 Kennedy et al. ..... 252/353
4,052,342 10/1977 Fernley et al. ..... 252/541
4,071,475 1/1978 Iijima et al. ..... 252/545

FOREIGN PATENT DOCUMENTS 56-133398 10/1981 Japan .
818158 8/1959 United Kingdom .

*Primary Examiner*—P. E. Willis, Jr.
*Attorney, Agent, or Firm*—Flynn, Thiel, Boutell & Tanis

[57] ABSTRACT

A liquid detergent composition is disclosed which comprises 5–25 wt. % of an ammonium alkyl sulfate, 0.2–10 wt. % of a polyoxyalkylene alkyl ether and 0.2–10 wt. % of a fatty acid dialkanolamide, these three components being included within specific ranges as shown in the attached drawing. The composition is suitable as a shampoo composition and has stability at both high and low temperatures and an improved foaming property.

4 Claims, 1 Drawing Figure

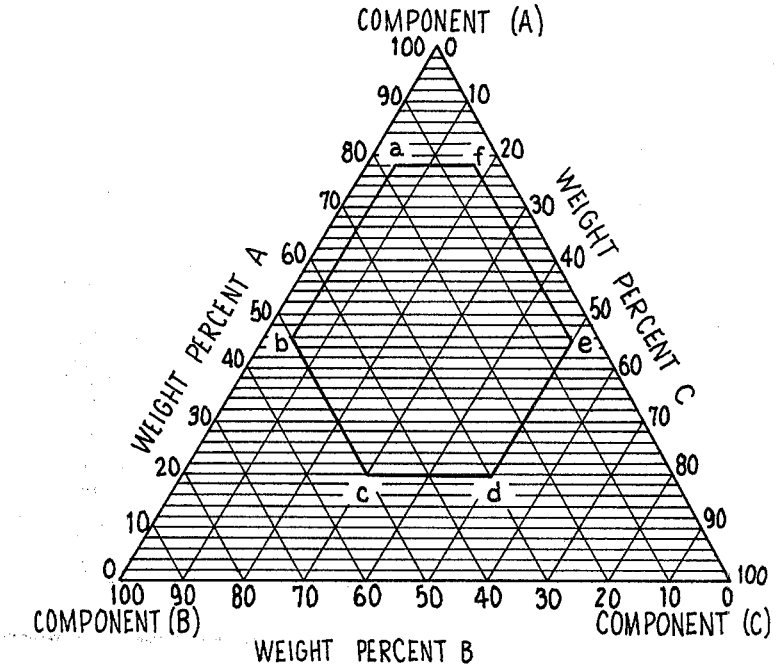
COMPONENT (A)
100
0
90
10
80
20
70
30
60
40
50
50
40
60
30
70
20
80
10
90
0
100
a
f
b
e
c
d
WEIGHT PERCENT A
WEIGHT PERCENT C
100 90 80 70 60 50 40 30 20 10 0
COMPONENT (B)
COMPONENT (C)
WEIGHT PERCENT B

LIQUID DETERGENT COMPOSITION COMPRISING AMMONIUM ALKYL SULFATE, POLYOXYALKYLENE ALKYL ETHER AND FATTY ACID DIALKANOLAMIDE

The present invention relates to a liquid detergent composition. More particularly, the present invention relates to a liquid detergent composition having a high detergency and excellent foaming property which requires no liquid stabilizer.

The liquid detergent composition of the present invention may be used for various purposes. Particularly, it is used advantageously as a shampoo composition. The present invention will be described in detail mainly in this aspect.

Conventional shampoo compositions contain as a shampoo base an anionic surfactant such as an alkyl sulfate salt, polyoxyethylene alkyl ether sulfate salt or α-olefinsulfonate salt, a nonionic surfactant such as polyoxyethylene alkyl ether or fatty acid alkylolamide or an amphoteric surfactant such as alkylbetaine or alkylamine oxide, either alone or in the form of a mixture of them. Various attempts have been made for improving the stability and other properties of these shampoo compositions. However, for instance, a polyoxyethylene alkyl ether sulfate which is generally used in the form of an adduct of 2–3 moles of ethylene oxide has a poor foaming property, though it has an excellent low-temperature stability. On the other hand, sodium or ammonium salt of an alkyl sulfate or sodium α-olefinsulfonate per se has a high Krafft point, poor low-temperature stability and a defect that it is solidified in winter, although it has excellent foaming and deterging powers. Therefore, the liquid condition of the above surfactant is unstable at the time of use after storage and, consequently, a phenomenon of precipitation or separation is observed and satisfactory results using the liquid shampoo cannot be obtained. Among the anionic surfactants, the ammonium alkyl sulfate has a particularly excellent foaming property and a good hair feel is obtained after washing with the same. However, it has fatal defects of a poor low-temperature stability and coloration at a high temperature.

After intensive investigations made for the purpose of overcoming these defects while the advantageous properties of the ammonium alkyl sulfate are maintained, the inventors have found that, surprisingly, a liquid detergent composition having excellent low-temperature stability, high-temperature stability and a high foaming power which affords a good hair feel after washing can be obtained by using a combination of an ammonium alkyl sulfate with a specific polyoxyalkylene alkyl ether and a fatty acid dialkanolamide in a specific ratio, without essentially using a liquid stabilizer such as propylene glycol, glycerol, ethyl alcohol or urea. The present invention has been completed on the basis of this finding.

BRIEF DESCRIPTION OF DRAWING

The FIGURE is a triangular diagram showing ratios of the three indispensable components used in the present invention.

The present invention provides a liquid detergent composition characterized in that it contains:

(A) 5–25 wt. % of an ammonium alkyl sulfate of general formula (1):

$$R_1OSO_3NH_4 \quad (1)$$

wherein $R_1$ represents a straight-chain or branched, saturated hydrocarbon group having 8–18 carbon atoms on the average, (B) 0.2–10 wt. % of a polyoxyalkylene alkyl ether of general formula (2):

$$R_2-\underset{\underset{R_3}{|}}{CH}-O-(\overset{\overset{R'}{|}}{C}HCH_2O)_nH \quad (2)$$

wherein $R_2$ represents an alkyl group having 6–14 carbon atoms, $R_3$ represents an alkyl group having 1–7 carbon atoms, R′ represents hydrogen or methyl group, and n represents the average molar number of addition which is an integer of 3–15, and (C) 0.2–10 wt. % of a fatty acid dialkanolamide of general formula (3):

$$R_4CON\begin{matrix} \diagup R''OH \\ \diagdown R'''OH \end{matrix} \quad (3)$$

wherein $R_4$ represents a straight-chain or branched, saturated or unsaturated hydrocarbon group having 7–17 carbon atoms, and R″ and R‴ each represent $C_mH_{2m}$ (m being 2–3), as indispensable components, and that the compositions of these three components are included within a range surrounded by straight lines connecting six points of a[(A)=78:(B)=17:(C)=5], b[(A)=45:(B)=50:(C)=5], c[(A)=20:(B)=50:(C)=30], d[(A)=20:(B)=30:(C)=50], e[(A)=45:(B)=5:(C)=50] and f[(A)=78:(B)=5:(C)=17] in a triangular diagram of the three components.

As groups $R_1$ in the ammonium alkyl sulfates of general formula (1) used in the present invention, straight-chain or branched, saturated hydrocarbon groups having 10–14 carbon atoms on the average are preferred. Starting alcohols of these esters may be either natural or synthetic alcohols. The alcohols are esterified with sulfuric acid by an ordinary method and then neutralized with aqueous ammonia. This is one of the methods for preparing the ammonium alkyl sulfate. Other conventional methods may be used.

As the secondary alcohols used as the starting material of polyoxyalkylene alkyl ether of the above general formula (2) (the second component used in the present invention), those obtained by oxidizing n-paraffins are most preferred. The n-paraffins have about 8–22 carbon atoms, particularly about 11–16 carbon atoms. As the oxyalkylenes to be added to the secondary alcohols, ethylene oxide is particularly preferred. The average molar number of addition is 3–15.

The fatty acid dialkanolamides used as the third, indispensable component of the present invention are shown by general formula (3). The starting fatty acids are preferably those having a carbon number distribution of 8–18, particularly those containing at least 40% of lauric acid ($C_{12}$). As the starting alkanolamines, diethanolamine and diisopropanolamine are particularly preferred.

The liquid detergent composition of the present invention may contain other components, for example, other known shampoo components in case it is used as a shampoo composition, in addition to the above three indispensable components. There may be incorporated in the detergent composition of the present invention, for example, amphoteric surfactants, nonionic surfactants, viscosity modifiers such as hydroxyethylcellulose, methylcellulose and higher alcohols, perfumes, dyes, U.V. absorbers, antioxidants, antiseptics and appearance-modifying agents (such as pearlescent pigment) in an amount which does not deteriorate the effects of the present invention, if necessary.

The liquid detergent composition of the present invention can be used in a broad pH range of from weakly acidic to weakly alkaline pH.

The following examples will further illustrate the present invention, which by no means limit the present invention.

Test methods in the following examples were as follows:

(1) Low-temperature stability

A sample was charged in a 100 ml transparent glass vessel. The vessel was tightly closed and stored in a constant temperature bath at −5° C. for one month. Change in condition of the sample was observed macroscopically.

O: The sample was homogeneous and transparent.

X: The precipitation or solidification was observed.

(2) High-temperature stability

A sample in a transparent vessel was stored in a constant temperature bath at 50° C. for one month and the coloring was judged macroscopically.

Macroscopic judgement of coloring:

O: The sample was not substantially colored.

X: The sample was colored.

(3) Foaming test method 0.1% of lanolin as an artificial dirt was added to 1% aqueous solution of a detergent composition. The whole was stirred by means of a flat propeller at 1000 rpm at 40° C. with the reversion at intervals of 10 seconds in a cylinder for 5 minutes. Thirty minutes after completion of the stirring, the amount of foam was measured.

EXAMPLE 1

Compositions containing the three indispensable components in various ratios as shown in Table 1 were prepared and their effects were examined. The results are shown in Table 1. The respective compositions were regulated to pH 7.0.

TABLE 1

| Composition No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Ammonium lauryl sulfate | 20 | | | 15 | 15 | 16 | 8 | 8 | 3 | 15 | 7 | 4 | 9 | 9 | 15.6 | 15.6 |
| Lauric acid diethanolamide | | 20 | | 5 | | 2 | 1 | 11 | 8 | 2.5 | 6.5 | 8 | 1 | 10 | 3.4 | 1 |
| Polyoxyethylene(3E.O.) sec.-alcohol($C_{12}$–$C_{14}$)ether | | | 20 | | 5 | 2 | 11 | 1 | 7 | 2.5 | 6.5 | 8 | 10 | 1 | 1 | 3.4 |
| Water | | | | | | | | Balance | | | | | | | | |
| Low-temperature stability | X | X water-insoluble | X | X | X | X | X | X | X | O | O | O | O | O | O | O |
| High-temperature stability | X | X | X | X | X | O | O | X | O | O | O | O | O | O | O | O |
| Foaming (ml) | 180 | 30 | 50 | 195 | 182 | 190 | 140 | 170 | 94 | 190 | 172 | 150 | 170 | 178 | 184 | 178 |

It is apparent from Table 1 that compositions in which the ratios of the three indispensable components were outside the range surrounded by six points (a, b, c, d, e and f) in FIG. 1 (compositions Nos. 1–9) had insufficient low-temperature stability and high-temperature stability.

EXAMPLE 2

Other solubilizers shown in Table 2 were used and the results were compared with that of composition No. 17 of the present invention. For comparison, sodium lauryl sulfate or triethanolamine salt of lauryl sulfate was used in place of ammonium lauryl sulfate.

TABLE 2

| Composition No. | 17 | 18 | 19 | 20 | 21 | 22 | 23 |
|---|---|---|---|---|---|---|---|
| Ammonium lauryl sulfate | 12% | 12% | 12% | 12% | 12% | | |
| Sodium lauryl sulfate | | | | | | 12% | |
| Triethanolamine salt of lauryl sulfate | | | | | | | 12% |
| Lauric acid diethanolamide | 3 | 3 | 3 | 3 | 3 | 3 | 3 |
| Polyoxyethylene (7E.O.) sec.-alcohol ($C_{12}$–$C_{14}$)ether | 2 | | | | | 2 | 2 |
| Ethyl alcohol | | 5 | | | | | |
| Glycerol | | | 5 | | | | |
| Propylene glycol | | | | 5 | | | |
| Urea | | | | | 5 | | |
| Water | | | | Balance | | | |
| Low-temp. stability | O | X | X | X | X | X | O |
| High-temp. stability | O | X | X | X | X | O | X |
| Foaming (ml) | 192 | 160 | 162 | 164 | 160 | 134 | 96 |

It is apparent from Table 2 that when the other solubilizers were used, the low-temperature stability and high-temperature stability were not improved, that when ammonium lauryl sulfate was replaced with sodium lauryl sulfate, the low-temperature stability was poor and that when ammonium lauryl sulfate was replaced with triethanolamine salt of lauryl sulfate, the high-temperature stability was poor and the foaming properties were insufficient in the two latter cases.

EXAMPLE 3

Effects of detergent composition No. 24 of the present invention were compared with those of compositions containing various other nonionic surfactants (compositions No. 25–29). The results are shown in Table 3.

TABLE 3

| Composition No. | 24 | 25 | 26 | 27 | 28 | 29 |
|---|---|---|---|---|---|---|
| Ammonium lauryl sulfate | 12% | 12% | 12% | 12% | 12% | 12% |
| Lauric acid diethanolamide | 4 | 4 | 4 | 4 | 4 | |
| Polyoxyethylene(15E.O.) sec.-alcohol($C_{12}$–$C_{14}$)ether | 4 | | | | | 4 |
| Polyoxyethylene(18E.O.) sec.-alcohol($C_{12}$–$C_{14}$)ether | | 4 | | | | |
| Polyoxyethylene(3E.O.) primary lauryl ether | | | 4 | | | |

TABLE 3-continued

| | | | | | | |
|---|---|---|---|---|---|---|
| Polyoxyethylene(3E.O.) nonylphenyl ether | | | 4 | | | |
| Polyoxyethylene(9E.O.) nonylphenyl ether | | | | | 4 | |
| Lauric acid monoethanolamide | | | | | | 4 |
| Water | | | Balance | | | |
| Low-temp. stability | O | X | X | X | X | X |
| High-temp. stability | O | X | O | O | O | O |
| Foaming (ml) | 188 | 180 | 160 | 132 | 140 | 198 |

The embodiments of the invention of which an exclusive property or privilege is claimed are defined as follows:

1. A liquid detergent composition having good stability at low and high temperatures and high foaming power, consisting essentially of:

(A) 5–25 wt. % of an ammonium alkyl sulfate of the formula:

$$R_1OSO_3NH_4 \quad (1)$$

wherein $R_1$ is straight-chain or branched-chain, saturated hydrocarbon group having 8–18 carbon atoms on the average;

(B) 0.2–10 wt. % of a polyoxyalkylene alkyl ether of the formula:

$$R_2-\underset{\underset{R_3}{|}}{CH}-O-(\overset{\overset{R'}{|}}{C}HCH_2O)_nH \quad (2)$$

wherein $R_2$ is alkyl having 6–14 carbon atoms, $R_3$ is alkyl having 1–7 carbon atoms, R′ is hydrogen or methyl, and n is an integer in the range of 3–15;

(C) 0.2–10 wt. % of a fatty acid dialkanolamide of the formula:

$$R_4CON\begin{matrix}\diagup R''OH \\ \diagdown R'''OH\end{matrix} \quad (3)$$

wherein $R_4$ is a straight-chain or branched-chain, saturated or unsaturated hydrocarbon group having 7–17 carbon atoms, R″ and R‴ each is $C_mH_{2m}$, and m is 2 or 3, with the proviso that the relative proportions of components A, B and C lie on or within the polygon defined by the straight lines connecting points a, b, c, d, e and f in the attached drawing; and the balance is essentially water.

2. A liquid detergent composition as claimed in claim 1, wherein $R_1$ has 10 to 14 carbon atoms, $$R_2-\overset{|}{CH}-R_3$$

has a total of 11 to 16 carbon atoms, and $R_4CO$— comprises at least 40 wt. % of lauric acid residue ($C_{12}$).

3. A liquid detergent composition as claimed in claim 1, wherein said component (A) consists of ammonium lauryl sulfate, said component (B) consists of polyoxyethylene sec-alcohol ($C_{12}$–$C_{14}$) ether, and said component (C) consists of lauric acid diethanolamide.

4. A liquid detergent composition as claimed in claim 1, which is free of a liquid stabilizer for components A, B and C.

* * * * *